United States Patent [19]

van Os

[11] Patent Number: 4,493,158

[45] Date of Patent: Jan. 15, 1985

[54] METHOD AND APPARATUS FOR REMOVING CONDENSATE FROM A CYLINDER, IN PARTICULAR A CYLINDER FOR DRYING PAPER

[75] Inventor: Rudi van Os, Ulestraten, Netherlands

[73] Assignee: Koninklijke Nederlandse Papierfabrieken N.V., Ak Maastricht, Netherlands

[21] Appl. No.: 433,914

[22] Filed: Oct. 12, 1982

[30] Foreign Application Priority Data

Oct. 13, 1981 [NL] Netherlands ..... 8104656

[51] Int. Cl.[3] ..... F26B 3/24; F26B 13/18

[52] U.S. Cl. ..... 34/41; 34/48; 34/49; 34/54; 34/124

[58] Field of Search ..... 34/119, 124, 54, 48, 34/41, 49

[56] References Cited

U.S. PATENT DOCUMENTS

| | | | |
|---|---|---|---|
| 3,251,138 | 5/1966 | Whittaker | 34/124 |
| 4,106,211 | 8/1978 | Holik | 34/124 |
| 4,222,178 | 9/1980 | Moran | 34/119 |
| 4,253,245 | 3/1981 | Perrault | 34/124 |

*Primary Examiner*—Larry I. Schwartz

*Attorney, Agent, or Firm*—LeBlanc, Nolan, Shur & Nies

[57] ABSTRACT

A method and apparatus for the removal of condensate from a cylinder, in particular a cylinder for drying paper by means of steam supplied under pressure to the interior of the cylinder via a first conduit. The steam, partially condensed to water, is removed from the cylinder through a second conduit. Optimum discharge of condensate is achieved, even at higher cylinder speeds by separating the fluid in the second conduit into a gaseous component and a liquid component, measuring the quantity of the gaseous component, and keeping the same constant by control means.

7 Claims, 1 Drawing Figure

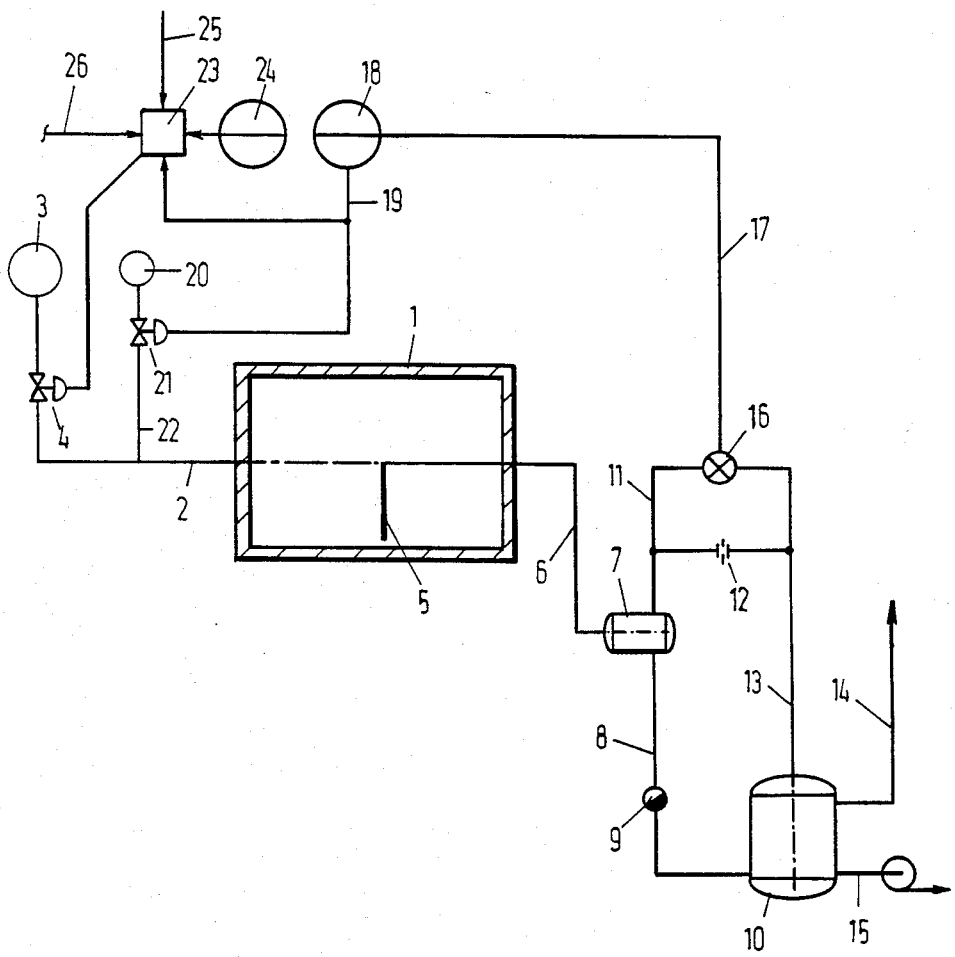
25
26
23
24
18
19
3
20
17
1
21
4
22
16
11
2
6
7
12
5
13
14
8
9
10
15

METHOD AND APPARATUS FOR REMOVING CONDENSATE FROM A CYLINDER, IN PARTICULAR A CYLINDER FOR DRYING PAPER

This invention relates to a method and apparatus for the removal of condensate from a cylinder, in particular a cylinder for drying paper, to which cylinder a fluid under pressure is supplied via a first conduit, and with which cylinder means are coupled for the removal of this fluid via a second conduit.

In the production of paper, a water/paper mixture, for example having a water-to-paper ratio of 200:1 is processed in successive stages to withdraw an ever larger quantity of water. For this purpose, use is made, inter alia, of presses, by means of which the water content can be reduced to about 60%. The semi-dry mixture is subsequently passed in a broad ribbon over a plurality of rotating drying cylinders. These cylinders are hollow and closed at the sides. In order to further dry the paper ribbon or web passed over the cylinders, steam is supplied to the interior of each cylinder as a drying fluid, which steam gives up heat to the paper web via the cylinder wall. As a result of this heat transfer, at least a portion of the steam is condensed to water. The condensate must be removed from the cylinder, because a layer of condensate within the cylinder adversely affects the transfer of heat from the steam to the cylinder wall, and when not removed, the cylinder ultimately becomes full of water.

As a result of the centrifugal force, at a rotational speed of the cylinder higher than 350 m/minute, the condensate is not only present on the bottom of the cylinder, but a layer of condensate is formed throughout the entire inner circumference of the cylinder. For the removal of the condensate, there is commonly provided a syphon in the cylinder, which may be stationary, or adapted to rotate. The syphon inlet is positioned within the cylinder spaced a small distance from the cylinder wall, and the syphon outlet is disposed adjacent to the longitudinal axis of the cylinder.

For the removal of the condensate from the cylinder, a system is known in which the centrifugal force on the condensate layer clinging against the cylinder wall is calculated from the peripheral velocity of the cylinder, which is known, and the pressure of the supplied steam is selected to exceed the pressure required to discharge the condensate. By supplying an excess of steam, the condensate in the cylinder is pressed upwards through the syphon as a result of the overpressure, and condensate droplets are entrained by the non-condensed steam. In this way, when the system is correctly dimensioned, there can only be a very thin layer of condensate continuously present on the cylinder wall.

The pressure in the cylinders and the pressure differential across the syphons is kept constant by control apparatus. In order to ensure that no cylinder is flooded with condensed water and a cylinder, once flooded, is automatically de-watered, the pressure differential must be adapted to the centrifugal force that has to be overcome when condensate only is discharged. As the pressure differential across the syphon is kept constant by the control apparatus, the reaction force is determined by the centrifugal force on the gas/condensate mixture and the resistance which this mixture experiences as a result of the current towards and through the syphon. When gas (steam) can enter the syphon pipe through the inlet thereof, a strong current of gas will be generated in the syphon as a result of the fact that the centrifugal force on the gas is negligible. The dynamic force of this gas current atomizes the condensate, whereby the condensate droplets are entrained with the gas current to the outlet. If, however, a large amount of condensate is present in the cylinder, the mixture is rich in condensate, and the reaction force will rapidly be reached, which is at the expense of the quantity of gas. This means that at the very moment when, in connection with the large quantity of condensate to be removed, a large quantity of gas is needed, the control system keeps this quantity small. In addition, in practice, as a result of technical problems, the pressure differential is selected lower than that actually required. The consequence is that, in the prior system, cylinders which function well may suddenly become flooded with condensate.

In modern paper making machines, the aim is for an increase in rotary speed of the cylinders, which increase in velocity results in an increase in centrifugal force, and hence in rendering the required steam pressure for the removal of the condensate still higher. The required minimum pressure and the associated temperature in the cylinder are increased to such an extent as to render impossible a proper control of the moisture evaporation process, which is necessary for making high-quality paper. If, in the prior system, it is desired for the rate of evaporation to be decreased, it is inevitable to tolerate a certain quantity of condensate in the cylinders.

It is an object of the invention to provide a method which makes it possible to control the rate of evaporation without having to tolerate an unduly large layer of condensate in the cylinders, while ensuring optimum discharge of condensate even at higher cylinder speeds.

To this effect the present invention provides a method of the above kind in which the fluid issuing from the discharge conduit of the cylinder is separated into a gaseous component and a liquid component, whereby the quantity of the gaseous component is measured and kept constant by control means.

In the method according to the invention, the pressure differential across the syphon adapts itself to the quantity of condensate to be transported. The maximum pressure differential, which in the prior method is continuously maintained, is virtually never reached in the method according to the invention, which is favourable for the energetic efficiency of the drying cylinder.

A further advantage is that the quantity of gas for transporting the condensate is virtually constant and in addition may be kept considerably smaller than in the prior method, by virtue of which it is possible for the diameter of the supply and discharge conduits to be selected smaller than in the prior method. Still another advantage of the method according to the invention is that the amount of energy required for drying the paper may be minimal, because it is always ensured that there is a very thin layer of condensate on the inside of the cylinder.

Still another advantage is that the drive for rotating the cylinders needs to be of less heavy construction than with the prior method. In fact, in the prior method, the drive must be designed for rotating a cylinder entirely flooded with condensate; such a flooded cylinder cannot occur in the method according to the present invention.

In a preferred embodiment of the invention, a source of steam is coupled via a first controllable valve with the fluid supply conduit, and a source of compressed air is coupled via a second controllable valve also to said fluid supply conduit, the arrangement being such that when the measured quantity of gaseous component is too low, this is controlled in the first instance by controlling the degree of opening of said first valve and in the second instance, when said first valve has been opened to a predetermined position, by controlling the degree of opening of said second valve, and when the measured quantity of gaseous component is too large, in the first instance the degree of opening of the second valve is controlled and in the second instance, when said second valve is fully closed, the degree of opening of said first valve is controlled.

The invention also provides an apparatus for the removal of condensate from a cylinder, in particular a cylinder for drying paper, comprising a first conduit for the supply of a fluid under pressure to said cylinder and a second conduit for the removal of said fluid, there being provided means for separating the fluid in the discharge conduit into a gaseous component and a liquid component, a measuring means for determining the quantity of gaseous component, and control means for keeping the quantity of gaseous component at a constant value.

Preferably the apparatus comprises a source of steam which via a first controllable valve is coupled with the fluid supply conduit, and with a source of compressed air which via a second controllable valve is also coupled to said fluid supply conduit, said first and said second valve being coupled with said control means.

One embodiment of the invention will now be described with reference to the accompanying drawing, which diagrammatically shows the control system according to the present invention for de-watering a paper drying cylinder.

To a drying cylinder 1, steam is supplied via a conduit 2 from a source of steam 3. The quantity of steam can be adjusted by means of a controllable valve 4.

From cylinder 1, via a syphon 5 and a conduit 6, gas with condensate is discharged to separator 7. In separator 7, condensate and gas are separated. The condensate is supplied via a conduit 8 and a steam trap 9 to a receptacle 10.

The gas is supplied via a conduit 11 to an orifice plate 12, by means of which the quantity of gas flowing through it can be determined by means of the pressure difference measured.

The gas is subsequently also supplied to receptacle 10 via conduit 13. Further connected to this receptacle are a further conduit 14 for the removal of gas under low pressure, and a conduit 15 for the discharge of condensate.

The pressure in receptacle 10 must be selected at least so much lower than the pressure in steam supply conduit 2 that the velocity of the steam in the valve is critical. At a critical steam velocity through valve 4, there is a unique relatitonship between the adjusted position of the valve and the amount of steam passed.

The pressure difference of the gas flowing through orifice plate 12 is converted in measuring device 16 into a certain air pressure. This air pressure is passed via conduit 17 to a control device 18. Control device 18 can ensure that the pressure difference across orifice plate 12 is maintained at a pre-determined, constant value by controlling the supply of gas to the drying cylinder. In this way it is possible to keep the gas flow velocity in syphon 5 constant at a pre-determined value independent of the amount of condensate.

Control device 18 gives via conduit 19 a control air pressure signal to the controllable valves 21 and 4 for the supply of gas. This signal varies in a certain range, e.g. from 1 to 2 bar. When all of the steam that can enter via valve 4 is condensed in the cylinder, control device 18 finds that there is an insufficient pressure difference across orifice plate 12, and increases the controlling air pressure in conduit 19. As the degree of opening of valve 4 for the supply of steam is limited to a maximum value, in accordance with the present invention, a second kind of gas which cannot be condensed, such as compressed air, is supplied from a source of compressed air 20 via controllable valve 21 and conduit 22. At the maximum controlling pressure, valve 21 is in the fully open position, and at approximately half the value of the controlling air pressure range, it is fully closed.

As steam and air flow into the cylinder, heat transfer by the steam will be decreased, and a mixture of steam and air will flow through the orifice plate. If control device 18 now finds that the adjusted threshold value of the pressure difference across orifice plate 12 is exceeded, it decreases the control pressure in conduit 19 to such an extent that via valve 21 for the compressed air an equilibrium is reached.

If the amount of steam flowing through valve 4 is much larger than can be condensed within the cylinder, control device 18 will find that the pressure difference across orifice plate 12 is too high, while the valve for the compressed air is already closed. In that case the controlling air pressure in conduit 19 is decreased to below approximately half the value of the control pressure range.

Conduit 19 is connected via a relay 23 to valve 4. Relay 23 operates as follows: If control pressures of four different levels are supplied, only the lowest level is passed to valve 4, and the others are ignored. In the embodiment shown, control valve 4 is open at a control pressure approximately halfway the control pressure range, and closed at the minimum control pressure.

In addition to the control of the supply via the control air-pressure, relay 23 may have three other functions:

1. Via a reduction valve 24, the maximum permissible steam supply to the cylinders can be adjusted. The limitation of the maximum value of the drying capacity is of very great importance at some moments during the paper making process.

2. Via a conduit 25, a control pressure can be supplied for the paper moisture control. During and at the end of the manufacturing process, the absolute moisture content of the paper web is measured and controlled via a moisture control which affects the supply of steam to one or more cylinders. It has been found that this makes for a moisture control with an accuracy that has not hitherto been possible.

3. Via a conduit 26, the amount of steam can be reduced during interruptions in production. This makes it possible to prevent cylinder temperatures from increasing to an undesirable high value during interruptions in production.

The great advantage of the method according to the invention is that the amount of steam supplied to the cylinders can be very accurately controlled, and limited to a minimal quantity without the occurrence of any problems with regard to the flooding of the cylinder with condensate, but the method also permits an accurate control of the amount of heat given up to the paper web, and minimizes loss in energy. In addition, by controlling the amount of compressed air supplied, optimal de-watering with a minimal amount of energy is possible.

Naturally, it is possible to combine certain parts of the control system, such as receptacle and source of steam for a plurality of cylinders, but in any case it is necessary for every cylinder to have its own separator, orifice plate and control circuit.

It will be clear that modifications of the control system described are possible in a large number of points without departing from the scope of the invention as defined in the claims.

I claim:

1. A method for removing condensate from a cylinder, in particular a cylinder for drying paper to which a fluid under pressure is supplied via a first conduit and with which means are coupled for removing that fluid via a second discharge conduit, said method including the steps of: separating the fluid in the discharge conduit of the cylinder into a gaseous component and a liquid component and measuring and keeping constant the quantity of the gaseous component, said method being characterized in that a source of steam is coupled via a first controllable valve with the fluid supply conduit and a source of compressed air is coupled via a second controllable valve to said fluid supply conduit and said method being further characterized in that the quantity of gaseous components is kept constant by the steps of controlling the degree of opening of said first valve and, when said first valve has been opened to a predetermined position, by controlling the degree of opening of said second valve when the measured quantity of gaseous components is too low and, when the measured quantity of gaseous components is too large, controlling the degree of opening of the second valve and, when said second valve is fully closed, controlling the degree of opening of said first valve.

2. A method according to claim 1, characterized by the step of also controlling the degree of opening of the first valve by way of a reducing valve for adjusting the maximum quantity of steam supplied to the cylinder.

3. A method according to claim 1, wherein there is a reducing valve for controlling the degree of opening of the first valve, and thereby adjusting the maximum quantity of steam supplied to the cylinder, characterized by the step of supplying a first control signal to the first valve in the event of breakage in a paper web being dried and by the step of supplying a second control signal to the first valve in the event of the amount of moisture in the paper being found to be incorrect.

4. A method according to claim 3, characterized by the step of employing that control signal of the two aforesaid means for controlling the first valve which has the lowest value to determine the degree of opening of the first valve.

5. Apparatus for removing condensate from a cylinder, in particular a cylinder for drying paper, said apparatus comprising: a first conduit for supplying a fluid under pressure to said cylinder and a second discharge conduit for the removal of said fluid therefrom, said apparatus being characterized by means for separating the fluid in the discharge conduit into a gaseous component and a liquid component, a measuring means for determining the quantity of gaseous component, control means for keeping the quantity of gaseous component at a constant value, a source of steam which is coupled with the fluid supply conduit via a first controllable valve, and a source of compressed air which is coupled to said fluid supply conduit via a second controllable valve, said first valve and said second valve being controllable by said control means.

6. Apparatus according to claim 5, characterized in that said first valve is also coupled with means for controlling the maximum open position thereof.

7. Apparatus according to claim 5, characterized in that said first valve is also coupled with means for controlling the maximum open position thereof, and in that said first valve is coupled with means for controlling the steam supply in the event of an interruption in the drying process, and with means for controlling the amount of moisture in the paper.

* * * * *